US008505637B2

(12) United States Patent
McKee et al.

(10) Patent No.: US 8,505,637 B2
(45) Date of Patent: Aug. 13, 2013

(54) SYSTEM AND METHOD FOR FORMING A COILED TUBING CONNECTION

(75) Inventors: L. Michael McKee, Friendswood, TX (US); Bart Thomeer, Houston, TX (US); Harold Steven Bissonnette, Sugar Land, TX (US); Michael Ramsey, Missouri City, TX (US); Robert Bucher, Houston, TX (US); Michael H. Kenison, Missouri City, TX (US); Robert Greenaway, Stafford, TX (US)

(73) Assignee: Schlumberger Technolgoy Corporation, Sugar Land, TX (US)

( * ) Notice: Subject to any disclaimer, the term of this patent is extended or adjusted under 35 U.S.C. 154(b) by 48 days.

(21) Appl. No.: 12/976,515

(22) Filed: Dec. 22, 2010

(65) Prior Publication Data

US 2011/0089685 A1 Apr. 21, 2011

Related U.S. Application Data

(62) Division of application No. 11/466,335, filed on Aug. 22, 2006, now Pat. No. 7,861,776.

(51) Int. Cl.
*E21B 19/16* (2006.01)
*E21B 17/02* (2006.01)

(52) U.S. Cl.
CPC ..... *E21B 17/02* (2013.01)
USPC ..... 166/380; 166/85.1; 166/242.2

(58) Field of Classification Search
USPC ..... 166/378, 379, 380, 85.1, 242.2; 403/275, 403/28, 30; 138/109, 155; 29/451, 458, 29/525.01, 557
See application file for complete search history.

(56) References Cited

U.S. PATENT DOCUMENTS

| | | | | | |
|---|---|---|---|---|---|
| 211,164 | A | | 1/1879 | Klein | |
| 365,387 | A | | 6/1887 | Klein | |
| 1,128,634 | A | | 2/1915 | Talbot | |
| 2,673,751 | A | | 3/1954 | Finch | |
| 2,907,591 | A | | 10/1959 | Gulick | |
| 3,652,111 | A | * | 3/1972 | Dent | 285/382 |
| 3,803,532 | A | | 4/1974 | Taxon | |
| 4,129,062 | A | * | 12/1978 | Bergmann et al. | 409/140 |
| 4,796,928 | A | * | 1/1989 | Carlin et al. | 285/334 |
| 4,844,516 | A | | 7/1989 | Baker | |
| 4,911,573 | A | | 3/1990 | Pietro | |

(Continued)

FOREIGN PATENT DOCUMENTS

| | | | |
|---|---|---|---|
| CA | 2598154 | A1 | 2/2008 |
| DE | 4116771 | A1 | 11/1992 |

(Continued)

OTHER PUBLICATIONS

SPE 89527 LUFT, Development of a New Spoolable Mechanical Coiled Tubing Connector, Society of Petroleum Engineers 89527, Mar. 2004.

*Primary Examiner* — Cathleen Hutchins
(74) *Attorney, Agent, or Firm* — Michael Flynn; Timothy Curington; Robin Nava

(57) ABSTRACT

A coiled tubing connection system is used in a well. A connector having an engagement end is used to couple a wellbore device to the end of a coiled tubing. The connector is spoolable, and the engagement end comprises engagement features that facilitate formation of a connection that is dependable and less susceptible to separation.

11 Claims, 10 Drawing Sheets

(56) References Cited

U.S. PATENT DOCUMENTS

| | | | | |
|---|---|---|---|---|
| 5,150,752 | A * | 9/1992 | Gunst et al. | 166/97.1 |
| 5,238,273 | A | 8/1993 | Laflin et al. | |
| 5,251,695 | A | 10/1993 | Coronado | |
| 5,306,050 | A | 4/1994 | Laflin et al. | |
| 6,164,375 | A * | 12/2000 | Carisella | 166/65.1 |
| 6,474,701 | B1 | 11/2002 | Bowles et al. | |
| 6,561,278 | B2 | 5/2003 | Restarick et al. | |
| 6,766,858 | B2 | 7/2004 | Nguyen et al. | |
| 7,861,776 | B2 | 1/2011 | McKee et al. | |
| 2004/0112644 | A1 | 6/2004 | Chan et al. | |

FOREIGN PATENT DOCUMENTS

| | | | |
|---|---|---|---|
| GB | 1525258 | A | 9/1978 |
| GB | 2441204 | A | 2/2008 |
| WO | 9206322 | A | 4/1992 |

* cited by examiner

SYSTEM AND METHOD FOR FORMING A COILED TUBING CONNECTION

BACKGROUND

In many wellbore applications, connections are formed between coiled tubing and wellbore tools or other components such as subsequent sections of coiled tubing. Often, the coiled tubing connector must form a pressure tight seal with the coiled tubing. The connector end often is threaded for connecting the wellbore tool to the coiled tubing. Coiled tubing connectors can be designed to attach and seal to either the inside or the outside of the coiled tubing.

Examples of internal connectors include roll-on connectors, grapple connectors and dimple connectors. Roll-on connectors align circumferential depressions in the coiled tubing with preformed circumferential grooves in the connector to secure the connector to the coiled tubing in an axial direction. Grapple connectors utilize internal slips that engage the inside of the coiled tubing to retain the coiled tubing in an axial direction. Dimple connectors rely on a dimpling device to form dimples in the coiled tubing. The dimples are aligned with preformed pockets in the connector to secure the connector to the coiled tubing both axially and torsionally. Elastomeric seals can be used to provide pressure integrity between the connector and the coiled tubing. However, internal connectors constrict the flow area through the connector which can limit downhole tool operations.

Examples of external connectors include dimple connectors, grapple connectors and threaded connectors. This type of dimple connector relies on a dimpling device to create dimples in the coiled tubing. The dimple connector comprises set screws that are aligned with the dimples in the coiled tubing and threaded into the dimples. The set screws provide both an axial and a torsional connectivity between the connector and the coiled tubing. External grapple connectors use external slips to engage the outside of the coiled tubing for providing axial connectivity to the tubing. External threaded connectors rely on a standard pipe thread which engages a corresponding standard external pipe thread on the end of the coiled tubing. The threaded connection provides axial connectivity, but the technique has had limited success due to the normal oval shape of the coiled tubing which limits the capability of forming a good seal between the connector and the coiled tubing. External connectors, in general, are problematic in many applications because such connectors cannot pass through a coiled tubing injector or stripper. This limitation requires that external connectors be attached to the coiled tubing after the tubing is installed in the injector.

SUMMARY

The present invention comprises a system and method for forming coiled tubing connections, such as connections between coiled tubing and downhole tools. A connector is used to couple the coiled tubing and a downhole tool by forming a secure connection with an end of the coiled tubing. The connector comprises a unique engagement end having engagement features that enable a secure, rigorous connection without limiting the ability of the connector to pass through a coiled tubing injector. The connector design also enables maximization of the flow area through the connector. In some embodiments, additional retention mechanisms can be used to prevent inadvertent separation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for forming coiled tubing connections. The coiled tubing connections typically are formed between coiled tubing and a well tool for use downhole, however the coiled tubing connections can be formed between coiled tubing and other components, such as subsequent sections of coiled tubing. The coiled tubing connections are formed with a connector that is of similar outside diameter to the coiled tubing and uniquely designed to provide a secure, rigorous connection without limiting the ability of the connector to pass through a coiled tubing injector. Additionally, some coiled tubing connection embodiments utilize a retention mechanism to further guard against inadvertent separation of the coiled tubing connection.

Figure 1:
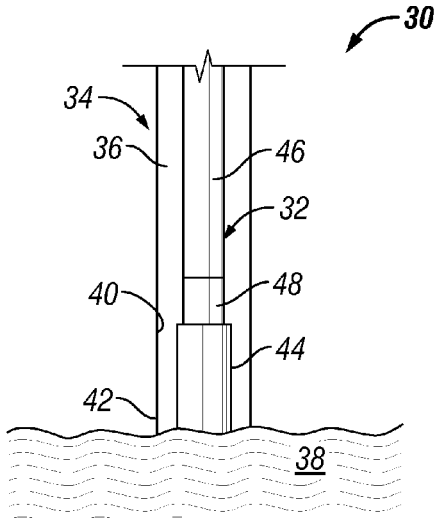
FIG. 1 is a front elevation view of a coiled tubing connection system deployed in a wellbore, according to one embodiment of the present invention.

Referring generally to FIG. 1, a well system 30 is illustrated according to one embodiment of the present invention. The well system 30 comprises, for example, a well intervention system 32 deployed for use in a well 34 having a wellbore 36 drilled into a reservoir 38 containing desirable fluids, such as hydrocarbon based fluids. In many applications, wellbore 36 is lined with a wellbore casing 40 having perforations 42 through which fluids can flow between wellbore 36 and the reservoir 38. Well intervention system 32 can be formed in a variety of configurations with a variety of components depending on the specific well intervention application for which it is used. By way of example, well intervention system 32 comprises a well tool 44 located downhole and coupled to a coiled tubing 46 by a connector 48. Connector 48 is securely attached to coiled tubing 46. The connection is sized to pass through a coiled tubing injector when rigging up to the well. The tool 44 is securely attached to the connector 48 after the connector is installed through the injector and well intervention system 32 is run downhole.

Figure 2:
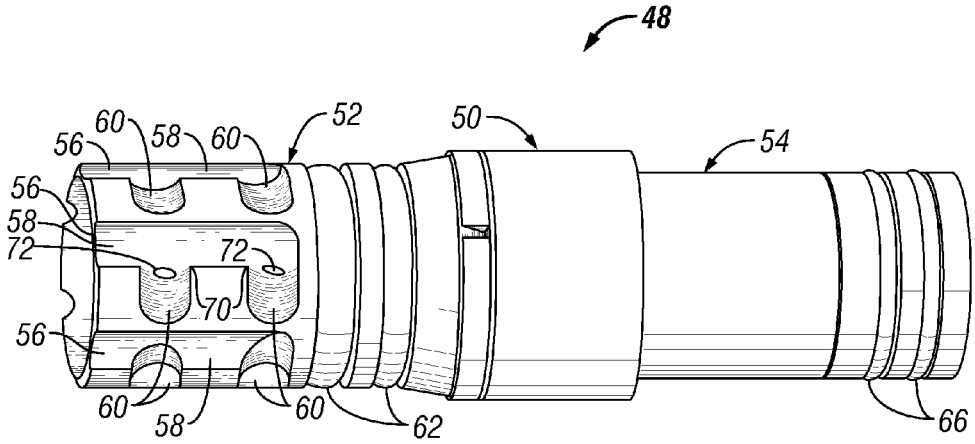
FIG. 2 is an orthogonal view of a bayonet style connector that can be used in the system illustrated in FIG. 1, according to an embodiment of the present invention.
Figure 3:
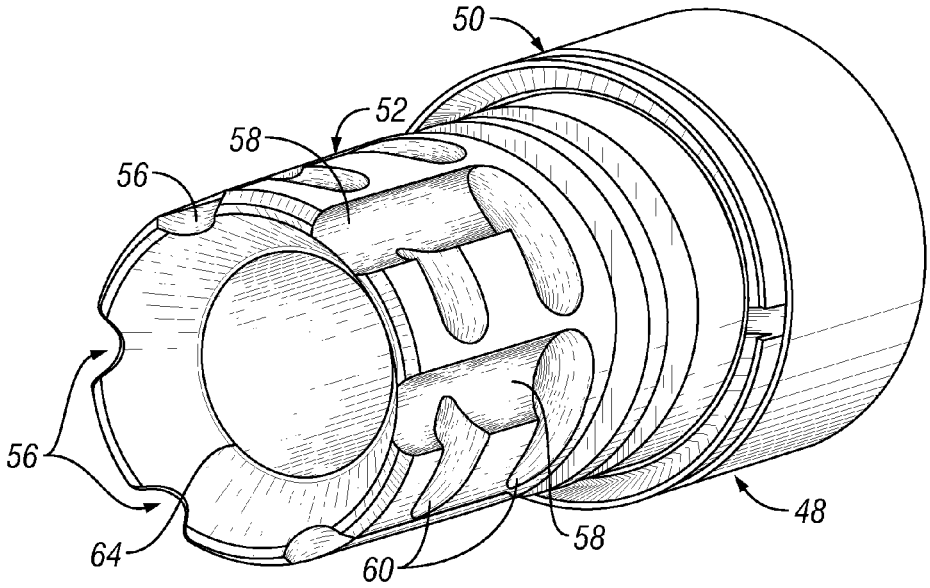
FIG. 3 is another view of the connector illustrated in FIG. 2, according to an embodiment of the present invention.

One embodiment of connector 48 is illustrated in FIGS. 2 and 3. In this embodiment, connector 48 comprises a midsection 50, a first engagement end or region 52 extending axially from the midsection 50, and a second engagement end or region 54 extending from midsection 50 in a direction generally opposite first engagement region 52. First engagement region 52 is designed for engagement with coiled tubing 46, and second engagement region 54 is designed for engagement with a component, such as well tool 44. As illustrated, midsection 50 may be radially expanded, i.e. comprise a greater diameter, relative to engagement regions 52 and 54.

The first engagement region 52 is sized for insertion into coiled tubing 46 and comprises one or more bayonet slots 56 recessed radially inwardly into engagement region 52. This form of engagement region can be referred to as a breech lock engagement region. Each bayonet slot comprises a generally longitudinal slot portion 58 intersected by one or more generally transverse slot portions 60. Transverse slot portions 60 may be substantially linear, curved, J-shaped, helical, or formed in other suitable shapes. Additionally, one or more seals 62, such as elastomeric seals, may be mounted on engagement region 52 in a location placing the seals 62 between the engagement region 52 and coiled tubing 46 when engagement region 52 is inserted into coiled tubing 46. Seals 62 may comprise O-rings, poly-pak seals or other seals able to form a sealed region between the coiled tubing 46 and connector 48. Connector 48 further comprises a hollow interior 64 that maximizes flow area for conducting well fluids therethrough, as best illustrated in FIG. 3.

The second engagement region 54 may have a variety of shapes and configurations depending on the specific type of well tool 44 or other component to be connected to coiled tubing 46 via connector 48. By way of example, engagement region 54 is a tubular threaded end sized for insertion into and threaded engagement with a corresponding receptacle of the component, e.g. well tool 44. One or more seals 66, such as O-rings, poly-pak seals or other suitable seals can be mounted around the engagement region 54, as illustrated, to form a fluid seal with well tool 44.

Figure 4:
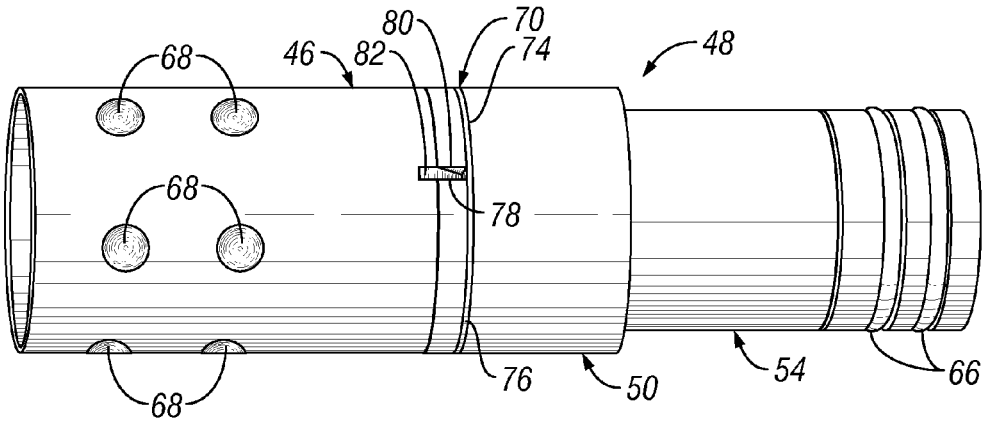
FIG. 4 is an orthogonal view of the connector coupled to an end of coiled tubing that has been formed with protrusions to engage the connector, according to an embodiment of the present invention.

The coiled tubing 46 is formed with one or more protrusions 68 that are sized and spaced to engage bayonet slots 56, as further illustrated in FIG. 4. Protrusions 68 extend radially inward into the interior of coiled tubing 46 and may be formed with pins, bolts, weldments, externally formed depressions or other suitable elements that protrude inwardly. In the embodiment illustrated, protrusions 68 are formed by applying localized pressure at selected locations along the exterior of coiled tubing 46 to create depressions that extended inwardly into the interior of coiled tubing 46. By way of example, the depressions can be formed in coiled tubing 46 with a screw type forming tool (see FIG. 24). Additionally, a depression forming mandrel can be placed inside the coiled tubing while the depressions are formed to accurately control the final shape of the protrusions 68 extending into the interior of the coiled tubing 46. In other applications, however, the depressions can be formed in the tubing without an inner mandrel or they can be formed while the coiled tubing is positioned directly on the connector 48. Regardless of the method of formation, the protrusions 68 are located such that longitudinal slot portions 58 of bayonet slots 56 can be aligned with the protrusions. The protrusions 68 are then moved along longitudinal slot portions 58 as engagement region 52 moves into the interior of coiled tubing 46. Once connector 48 is axially inserted, the connector 48 and coiled tubing 46 are rotationally twisted relative to each other to move the plurality of protrusions into the generally transverse slot portions 60.

After the coiled tubing 46 and connector 48 are joined through the relative axial and rotational movement, a retention mechanism 70 may be used to rotationally secure the coiled tubing protrusions 68 within their corresponding bayonet slots 56. One example of retention mechanism 70 comprises an interference mechanism, e.g. simple detents 72 (see FIG. 2), that hold protrusions 68 in transverse slot portions 60 once protrusions 68 are inserted longitudinally along longitudinal slot portions 58 and rotated into transverse slot portion 60. Another example of retention mechanism 70 (see FIG. 4) comprises a snap ring, e.g. a C-ring, member 74 that may be positioned within a corresponding slot 76 located, for example, circumferentially along midsection 50 of connector 48. C-ring member 74 further comprises a transverse pin 78 that is positioned in corresponding recesses 80, 82 of connector 48 and coiled tubing 46, respectively, when C-ring member 74 is pressed into slot 76. A variety of other retention mechanisms 70 also can be used, some of which are discussed in greater detail below.

Figure 5:
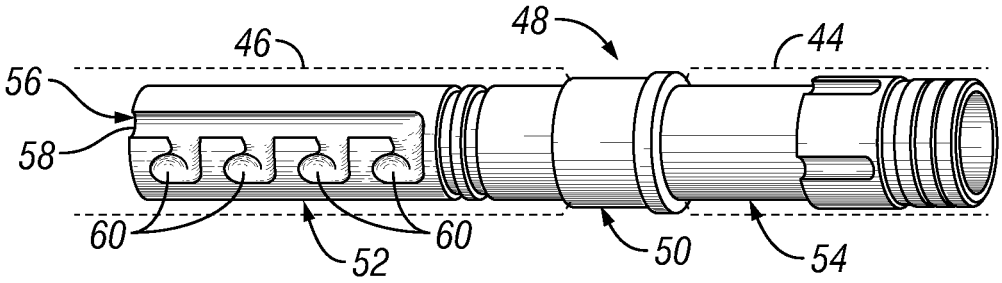
FIG. 5 is an alternate embodiment of the connector illustrated in FIG. 2, according to another embodiment of the present invention.

In the embodiment illustrated in FIGS. 2-4, each bayonet slot 56 is illustrated as having two transverse slot portions 60 for receiving corresponding pairs of protrusions 68. However, the bayonet slots 56 can be designed in other configurations with different numbers of longitudinal slot portions 58 and a different numbers of transverse slot portions 60 associated with each longitudinal slot portion. As illustrated in FIG. 5, for example, each longitudinal slot portion 58 is intersected by four transverse slot portions 60. Additionally, each transverse slot portion 60 has a generally J-shape as opposed to the linear shape illustrated best in FIG. 2. The embodiment illustrated in FIG. 5 provides one example of other potential bayonet slot configurations that can be used in coupling connector 48 with coiled tubing 46.

Figure 6:
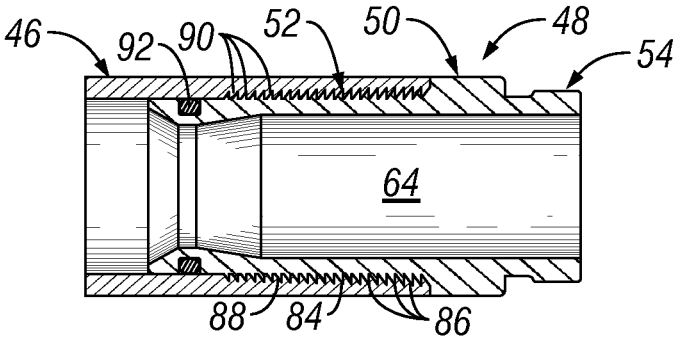
FIG. 6 is a cross-sectional view of an alternate embodiment of the connector threadably coupled with a coiled tubing end, according to an embodiment of the present invention.

In another embodiment, engagement region 52 of connector 48 comprises a threaded portion 84 having threads 86 for engaging a corresponding coiled tubing threaded portion 88 having threads 90, as illustrated in FIG. 6. In the embodiment illustrated, threads 86 are formed externally on engagement region 52 of connector 48, and the corresponding threads 90 are formed on the interior end of coiled tubing 46. The threads 86 and 90 are designed to absorb substantial axial loading. In some embodiments, an additional seal 92, such as an elastomeric seal, also may be deployed between engagement region 52 of connector 48 and the surrounding coiled tubing 46. Examples of seals 92 include O-ring seals, poly-pak seals or other seals able to form a seal between the coiled tubing 46 and connector 48. The seal area on either side of the elastomeric seal 92 is designed to form a metal to metal seal. In addition, threads that form a metal to metal seal can be used. Regardless, the threads also are selected such that they may be formed at the well site as opposed to being pre-manufactured in a factory environment. Examples of suitable threads include locking tapered threads, such as the Hydril 511 thread, the Tapered Stub Acme thread, the Tapered Buttress thread, and certain straight threads. The interference of the threads also can be designed such that the threads are sacrificial threads. In other words, once connector 48 and coiled tubing 46 are threaded together, the threads are plastically deformed and typically unusable for any subsequent connections, i.e. sacrificed, and the connector cannot be released from the coiled tubing.

The connectors illustrated herein enable preparation of the coiled tubing and formation of rigorous, secure connections while at the well site. Whether the connector utilizes bayonet slots or threads, the connection with coiled tubing 46 can be improved by preparing the coiled tubing end for connection. For example, the strength of the connection and the ability to form a seal at the connection can be improved by rounding the connection end of the coiled tubing through, for example, a swaging process performed at the well site. As illustrated in FIGS. 7-12, the coiled tubing 46 can be prepared with an internal swage or an external swage.

Figure 7:
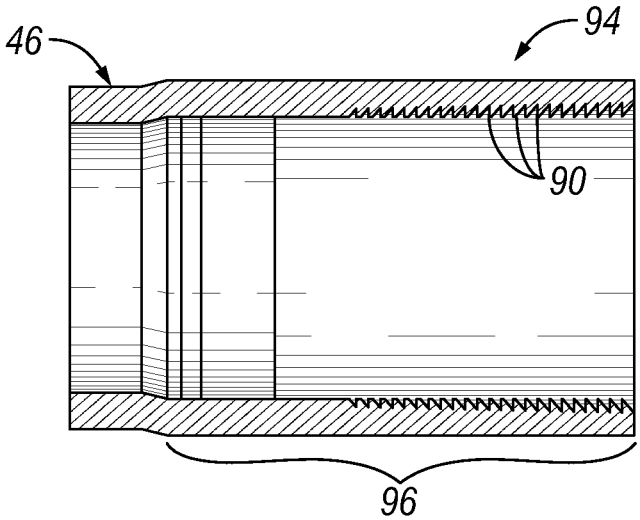
FIG. 7 is a cross-sectional view of a coiled tubing end that has been expanded and then threaded internally for engagement with the connector, according to an embodiment of the present invention.
Figure 8:
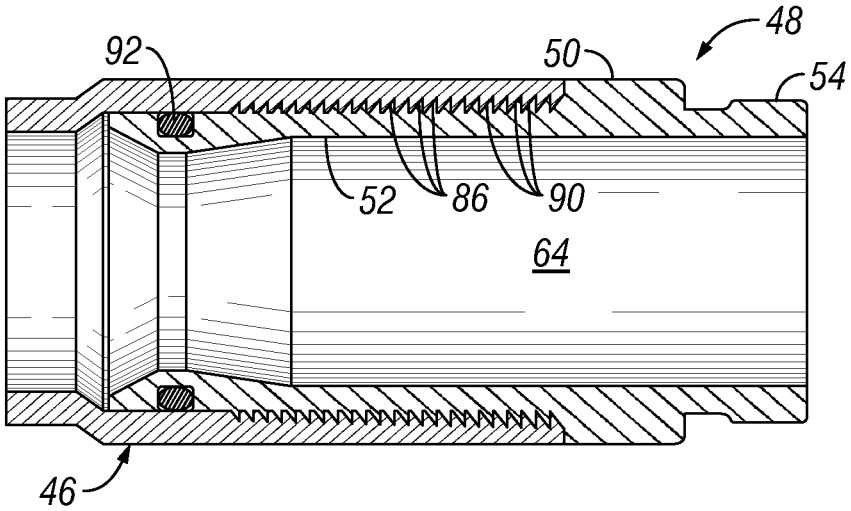
FIG. 8 is a view similar to that of FIG. 7 but showing a connector engaged with the coiled tubing end, according to an embodiment of the present invention.

Referring first to FIGS. 7 and 8, an end 94 of coiled tubing 46 is illustrated after being subjected to an internal swage that creates a swage area 96. Swage area 96 results from expanding the coiled tubing 46 at end 94 to a desired, e.g. maximum, outside diameter condition. The coiled tubing end 94 is caused to yield during swaging such that end 94 is near round and the outside diameter is formed to the desired, predetermined diameter. The interior of end 94 can then be threaded with threads 90 for engagement with connector 48, as illustrated in FIG. 8. In addition to rounding and preparing end 94 for a secure and sealing engagement with connector 48, the internal swaging can be used to maximize the flow path through connector 48. Furthermore, the swaging enables a single size connector 48 to be joined with coiled tubing sections having a given outside diameter but different tubing thicknesses. An external rounding fixture also can be used to round the coiled tubing for threading.

Figure 9:
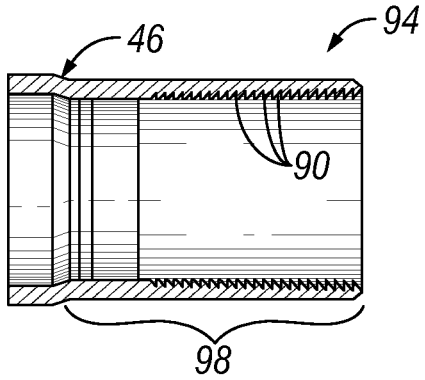
FIG. 9 is a cross-sectional view of a coiled tubing end that has been swaged radially inward and threaded for engagement with the connector, according to an embodiment of the present invention.
Figure 10:
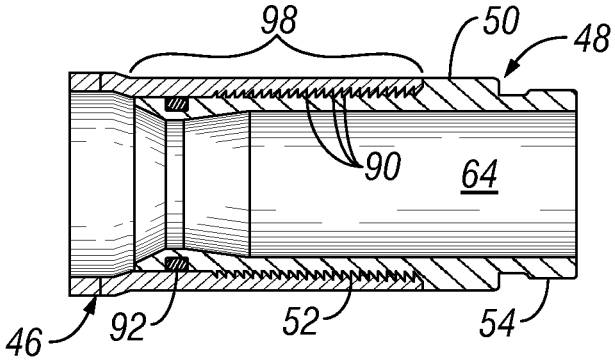
FIG. 10 is a view similar to that of FIG. 9 but showing a connector engaged with the coiled tubing end, according to an embodiment of the present invention.
Figure 11:
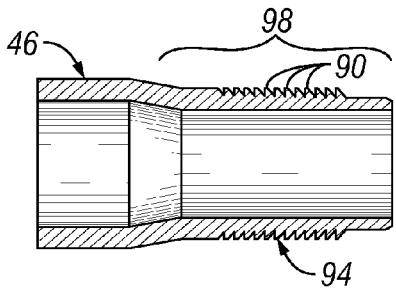
FIG. 11 is a cross-sectional view of a coiled tubing end that has been swaged radially and threaded externally for engagement with the connector, according to an embodiment of the present invention.
Figure 12:
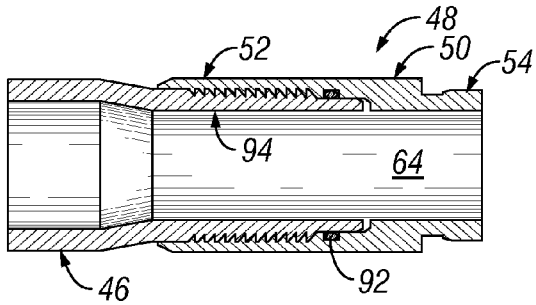
FIG. 12 is a view similar to that of FIG. 11 but showing the connector engaged with the coiled tubing end, according to an embodiment of the present invention.

Alternatively, the coiled tubing end 94 can be prepared via external swaging in which, for example, an external swage is used to yield the coiled tubing in a radially inward direction. In this embodiment, the coiled tubing 46 can be yielded back to nominal outside diameter dimensions. As illustrated in FIGS. 9 and 10, the external swaging creates a swage area 98 that is yielded inwardly and rounded for engagement with connector 48. As with the previous embodiment, threads 90 can be formed along the interior of swaged end 94 for a rigorous and sealing engagement with connector 48, as best illustrated in FIG. 10. In another alternative, swage area 98 can be created, and threads 90 can be formed on the rounded exterior end of coiled tubing 46, as illustrated in FIGS. 11 and 12. In this embodiment, threads 86 of connector 48 are formed on an interior of engagement region 52, as best illustrated in FIG. 12.

The methodology involved in rounding and otherwise preparing the coiled tubing for attachment to connector 48 enables field preparation of the coiled tubing at the well site. An example of one methodology for forming connections at a well site can be described with reference to the flowchart of FIG. 13. As illustrated in block 100 of the flowchart, the coiled tubing 46 and connectors 48 initially are transported to a well site having at least one well 34. Once at the well site, the end 94 of the coiled tubing 46 is swaged, as illustrated by a block 102. The swaging can utilize either an internal swage or an external swage, depending on the application and/or the configuration of connector 48. The swaging process properly rounds the coiled tubing for a secure, sealing engagement with the connector. In some applications, the swaging portion of the process requires that the coiled tubing seam be removed. When using an internal swage, for example, the coiled tubing seam formed during manufacture of the coiled tubing can be removed with an appropriate grinding tool.

If connector 48 comprises a threaded portion 84 along its engagement region 52, the threads 86 are cut into coiled tubing end 94, as illustrated by block 104. The threads can be cut at the well site with a tap having an appropriate thread configuration to form the desired thread profile along either the interior or the exterior of coiled tubing end 94. It should be noted that if connector 48 comprises an engagement region having bayonet slots 56, the swaging process can still be used to properly round the coiled tubing end 94 and to create the desired tubing diameter for a secure, sealing fit with the breech lock style connector. Once the end 94 is prepared, engagement region 52 of connector 48 is engaged with the coiled tubing. When using a threaded engagement region, the connector 48 is to threadably engaged with the coiled tubing 46, as illustrated by block 106. The connector 48 and coiled tubing 46 are then continually threaded together until an interfering threaded connection is formed, as illustrated by block 108. The interfering threaded connection forms a metal-to-metal seal and a rigorous connection able to withstand the potential axial loads incurred in a downhole application. Of course, the well tool 44 or other appropriate component can be coupled to engagement region 54 according to the specific coupling mechanism of the well tool prior to running the well tool and coiled tubing downhole.

Figure 13:
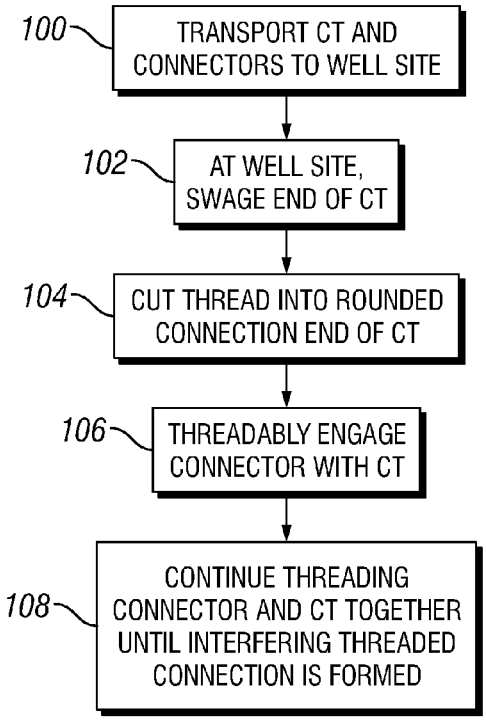
FIG. 13 is a flow chart illustrating a methodology for engaging a threaded connector with coiled tubing at a well site, according to an embodiment of the present invention.
Figure 14:
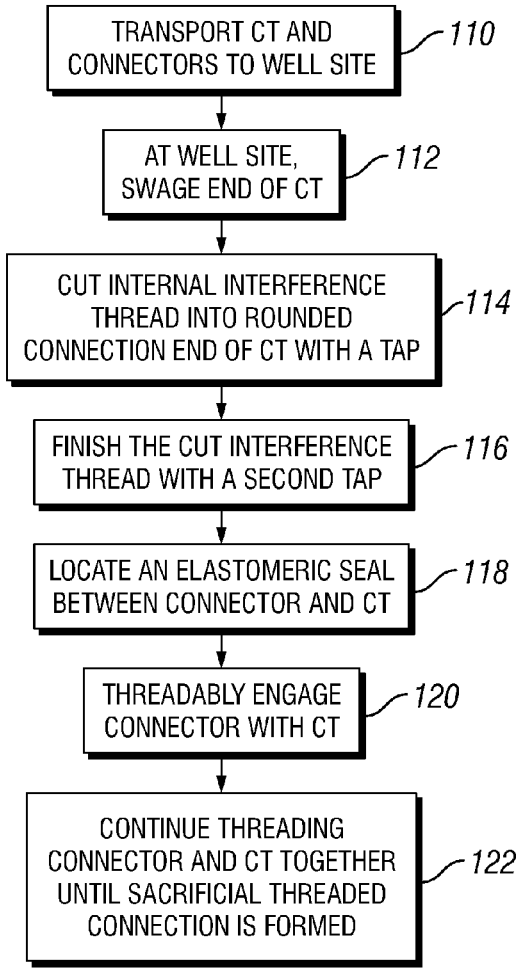
FIG. 14 is a flow chart illustrating a more detailed methodology for engaging a threaded connector with coiled tubing at a well site, according to an embodiment of the present invention.

FIG. 14 illustrates a slightly more detailed methodology of forming connections at a well site. In this embodiment, the coiled tubing 46 and connectors 48 are initially transported to the well site, as illustrated by block 110. The connection end of the coiled tubing 46 is then swaged, as described above and as illustrated by block 112. In this particular embodiment, an internal interference thread is cut into the interior of the rounded connection end 94 with a tap having an appropriate thread configuration, as illustrated by block 114. The cut interference threads are then finished with a second tap, as illustrated by block 116. A supplemental seal, such as elastomeric seal 92, is located between the connector 48 and the coiled tubing 46, as illustrated by block 118. The connector 48 and the coiled tubing 46 are then threadably engaged, as illustrated by block 120. In this example, the connector 48 and the coiled tubing 46 are threaded together until a sacrificial threaded connection is formed, as illustrated by block 122. The embodiments described with reference to FIGS. 13 and 14 are examples of methodologies that can be used to form stable, rigorous, sealed connections at a well site. However, alternate or additional procedures can be used including additional preparation of the coiled tubing end, e.g. chamfering or otherwise forming the end for a desired connection. Additionally, the connector 48 can be torsionally, i.e. rotationally, locked with respect to the coiled tubing 46 and/or the well device 44 via a variety of locking mechanisms, as described more fully below.

Figure 15:
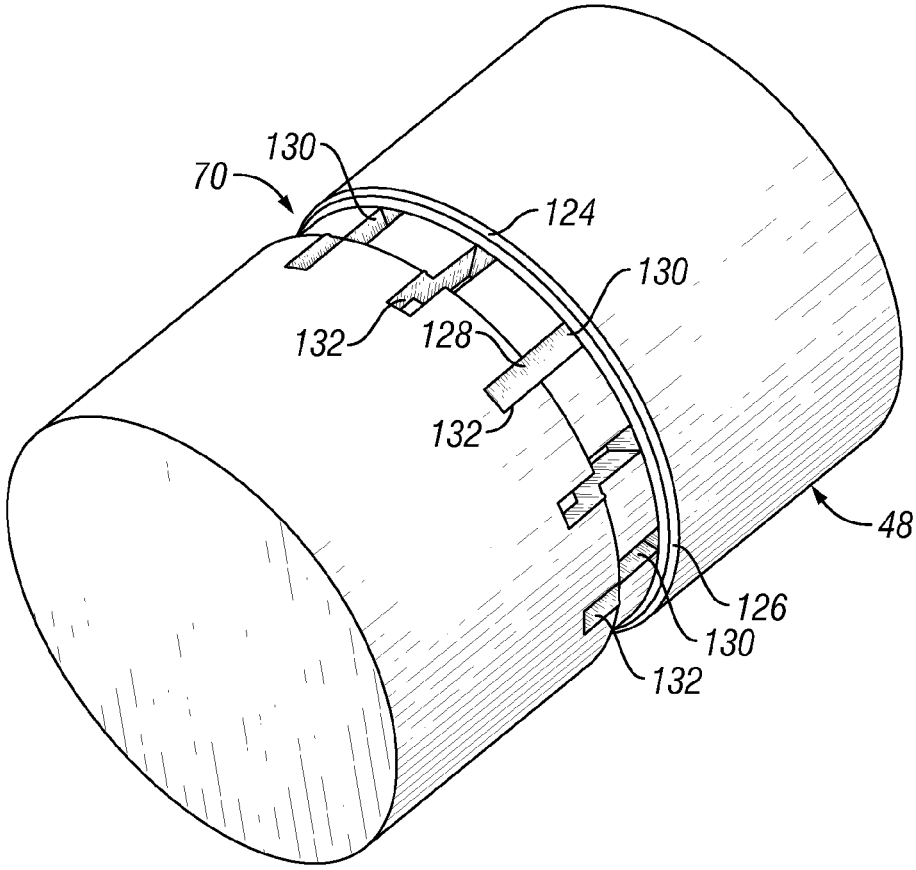
FIG. 15 is an orthogonal view of a retention system for rotationally retaining a connector with respect to coiled tubing, according to an embodiment of the present invention.

Depending on the type of engagement regions 52 and 54 used to engage the coiled tubing 46 and well tool 44, respectively, the use of retention mechanism 70 may be desired to lock the components together and prevent inadvertent separation. In addition to the examples of retention mechanism 70 illustrated in FIGS. 2 and 4, another embodiment of retention mechanism 70 is illustrated in FIG. 15. In this embodiment, a snap ring member 124, such as a C-ring, is designed to snap into a corresponding groove 126 formed, for example, in connector 48. However, groove 126 also can be formed in coiled tubing 46 or well tool 44. The snap ring member 124 further comprises a transverse pin 128, such as a shear pin. When snap ring member 124 is properly placed into groove 126, pin 128 extends through corresponding recesses or castellations 130, 132 formed in connector 48 and the adjacent component, e.g. coiled tubing 46, respectively. In the embodiment illustrated in FIG. 15, connector 48 comprises a plurality of castellations 130 circumferentially spaced, and coiled tubing 46 comprises a plurality of corresponding castellations 132 also circumferentially spaced. In one specific example, 15 castellations 130 are machined between groove 126 and the end of midsection 50 adjacent coiled tubing 46. In this same example, 12 corresponding castellations are machined into the corresponding end 94 of coiled tubing 46. This particular pattern of castellations provides matching notches within plus or minus one degree around the circumference of the connector. When pin 128 is disposed within corresponding castellations, the connected components are prevented from rotating with respect each other and are thus retained in a connected position, regardless of whether the connection is formed with bayonet slots 56 or threads 86. This method can be used for all tool joint connections within the downhole tool.

Figure 16:
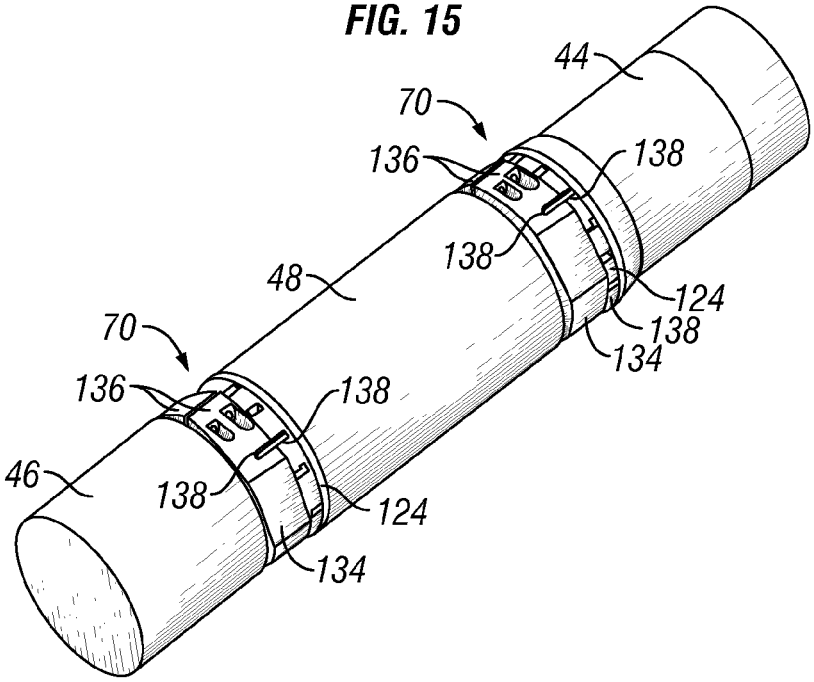
FIG. 16 is another embodiment of a retention system for rotationally retaining a connector with respect to coiled tubing, according to an embodiment of the present invention.

Another retention mechanism 70 is illustrated in FIG. 16. In this embodiment, one or more split ring locking mechanisms 134 can be used to connect sequentially adjacent components, such as coiled tubing 46, connector 48 and well tool 44. Each split ring locking mechanism 134 comprises a separate ring sections 136 that can be coupled together around the connection region between adjacent components. The split ring locking mechanism 134 comprises, for example, an internal thread that can be used to pull the adjacent components together when torque is applied to the split ring locking mechanism. Corresponding castellations 138 may be machined into each split ring locking mechanism 134 and an adjacent component to prevent unintended separation of the components, as discussed above. For example, a plurality of castellations can be machined into both the split ring locking mechanism 134 and the adjacent component. A snap ring member 124 can be positioned to prevent the split ring 134 from loosening, thereby securing the adjacent components. By way of specific example, each split ring locking mechanism 134 may comprise a pair of castellations, and each of adjacent component may comprise 12 castellations to facilitate alignment of the corresponding castellations for placement of the snap ring member 124. In this type of embodiment, the adjacent components, e.g. connector 48 and well tool 44, can be designed with connector ends having corresponding splines that mate with each other when the adjacent components are initially engaged. The one or more split ring locking mechanisms 134 are used to retain the adjacent components in this engaged position.

Figure 17:
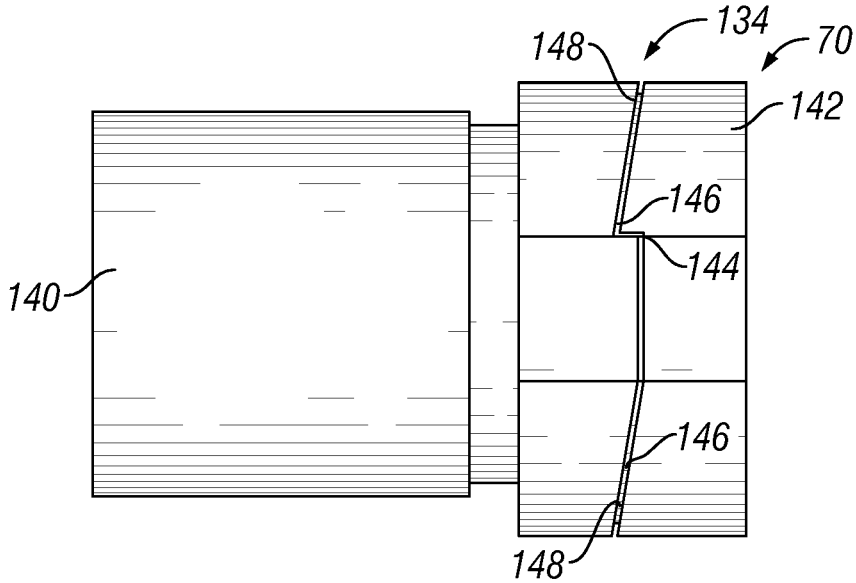
FIG. 17 is another embodiment of a retention system for rotationally retaining a connector with respect to coiled tubing, according to an embodiment of the present invention.
Figure 18:
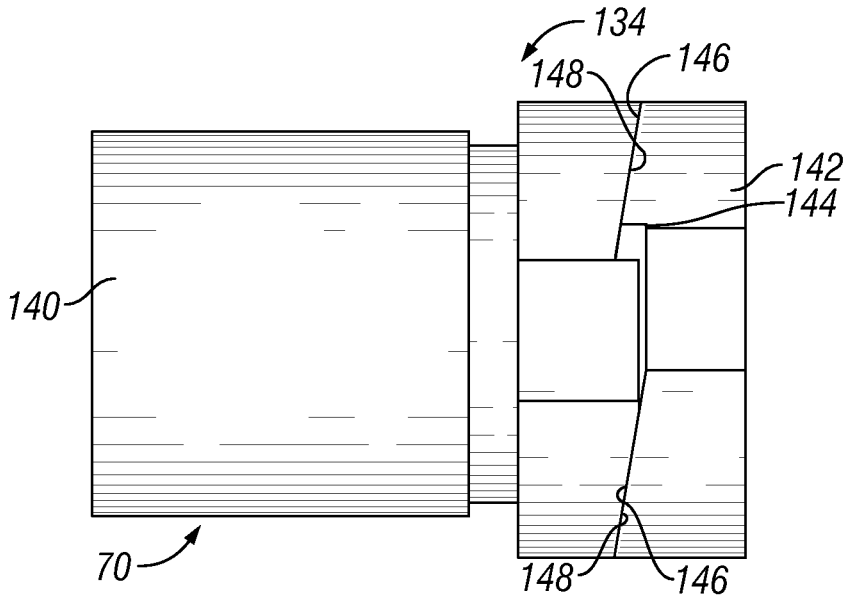
FIG. 18 is a view similar to that of FIG. 17 but showing the retention mechanism in a locked position, according to an embodiment of the present invention.

Another embodiment of the split ring locking mechanism 134 is illustrated in FIGS. 17 and 18. In this embodiment, the split ring locking mechanism 134 comprises a split ring portion 140 and a wedge ring portion 142. The wedge ring portion 142 has a mechanical stop 144 and one or more inclined or ramp regions 146 that cooperate with corresponding inclined or ramp regions 148 of split ring portion 140. With this type of split ring, the adjacent components are assembled as described above with reference to FIG. 16, and the split ring 134 is threaded onto an adjacent component until contacting a component shoulder and "shouldering out" on the inside of the connection. The ramp regions 146, 148 of the wedge ring portion 142 and the split ring portion 140 interfere with each other such that the wedge ring portion 142 rotates with the split ring portion 140. When the connection is tight, the split ring portion 140 is held in position and the wedge ring portion 142 is turned in the tightening direction. The ramp regions 146 force wedge ring portion 142 away from split ring portion 140 (see FIG. 18) and into a shoulder of the adjacent component. Friction holds the wedge ring portion 142 in place. If an external force acts on the split ring locking mechanism 134 in a manner that would tend to loosen the connection, ramp regions 146 are further engaged, thereby tightening the wedge and preventing the split ring mechanism from loosening.

Figure 19:
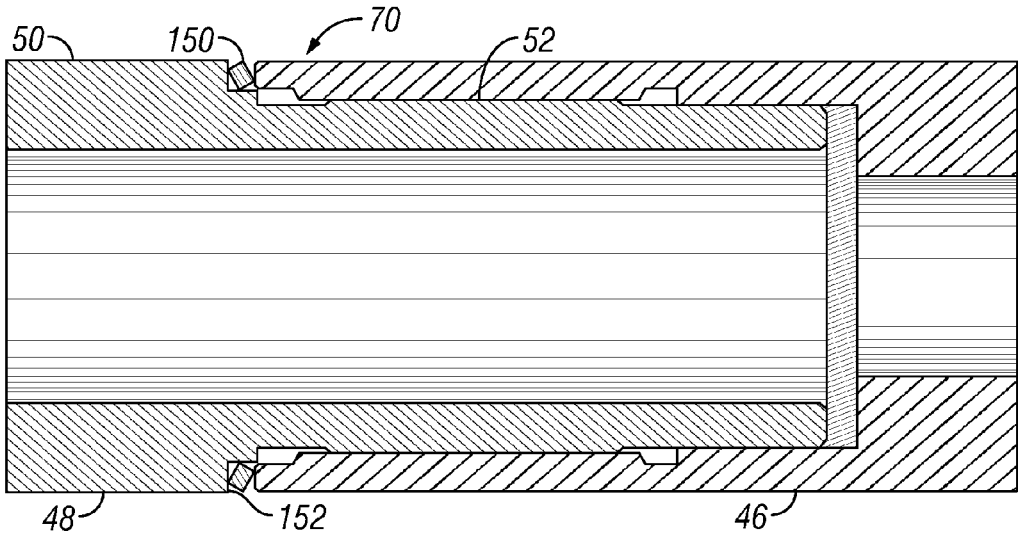
FIG. 19 is another embodiment of a retention system for rotationally retaining a connector with respect to coiled tubing, according to an embodiment of the present invention.
Figure 20:
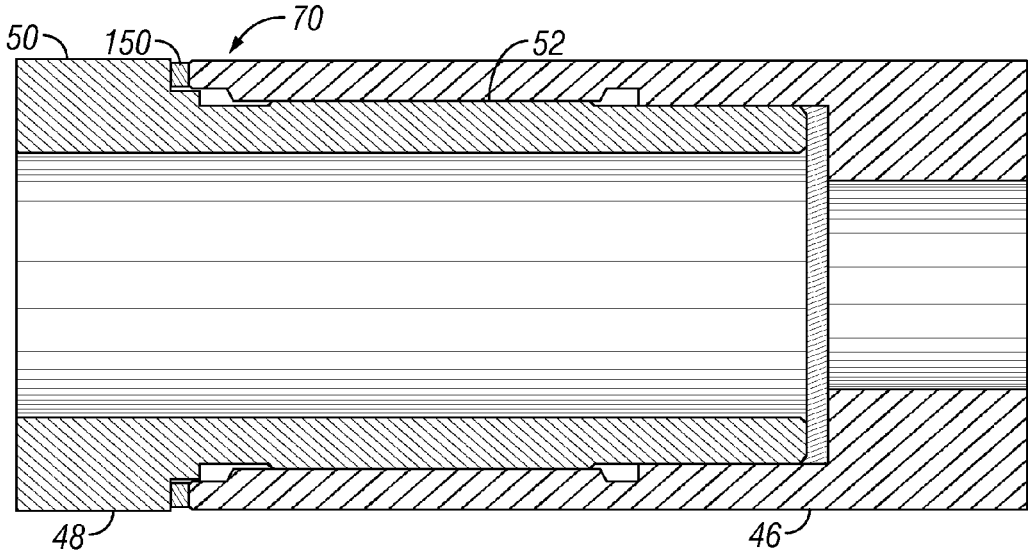
FIG. 20 is a view similar to that of FIG. 19 but showing the retention mechanism in a locked position, according to an embodiment of the present invention.

In another alternate embodiment, retention mechanism 70 may comprise a belleville washer or wave spring 150 positioned to prevent inadvertent loosening of adjacent components, such as connector 48 and coiled tubing 46. As illustrated in FIGS. 19 and 20, belleville washer 150 may be positioned between a shoulder 152 of a first component, e.g. connector 48, and the mating end of the adjacent component, e.g. coiled tubing 46. When the connection is tightened, such as by threading connector 48 into coiled tubing 46 as described above, the belleville washer 150 is transitioned from a relaxed state, as illustrated in FIG. 19, to a flattened or energized state, as illustrated in FIG. 20. The belleville washer 150 may be designed so the washer is fully flattened when the desired torque is applied to the connection. In the event a large axial load is applied to the connection, loosening of the connection is prevented by the washer due to the highly elastic nature of the belleville washer 150 relative to the elasticity of the connected components.

Figure 21:
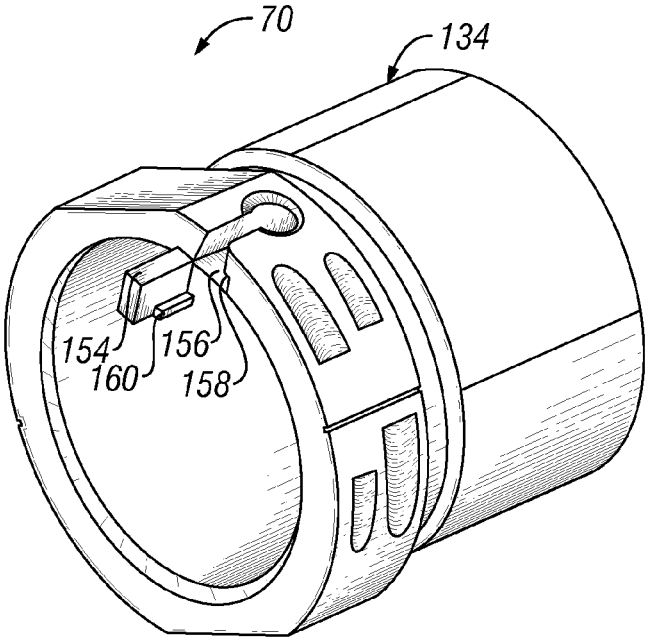
FIG. 21 is another embodiment of a retention device for rotationally retaining a connector with respect to coiled tubing, according to an embodiment of the present invention.
Figure 22:
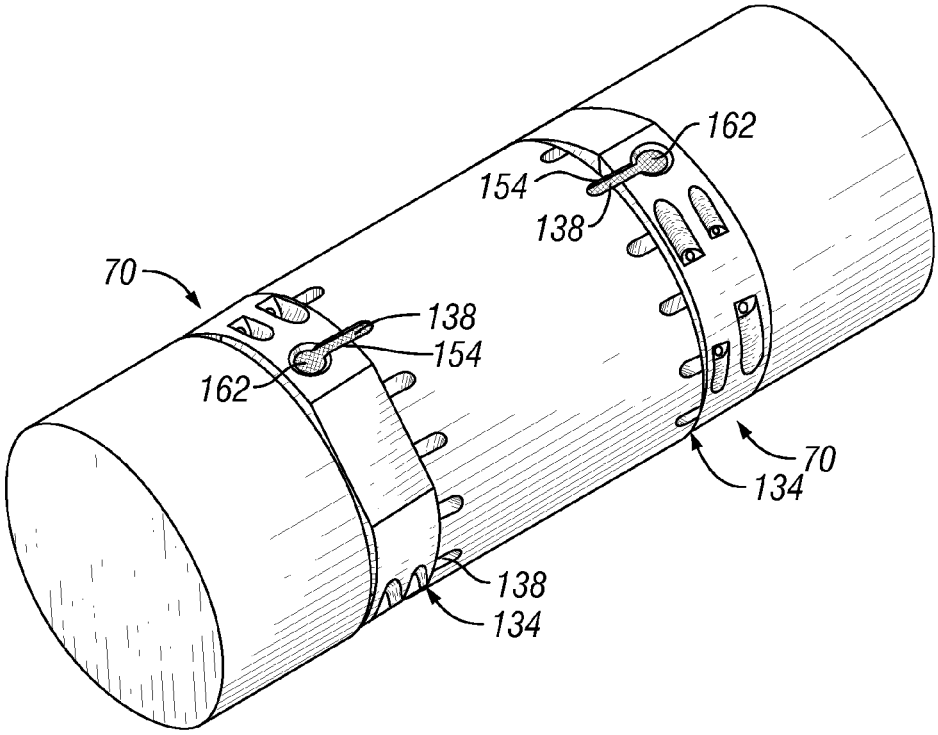
FIG. 22 illustrates the retention device of FIG. 21 incorporated into a retention system between a coiled tubing end and a wellbore component, according to an embodiment of the present invention.

Another embodiment of retention mechanism 70 is illustrated in FIGS. 21 and 22. In this embodiment, a key 154 is used in combination with a split ring locking mechanism 134 that may be similar to the design described above with reference to FIG. 16. Prior to installation, key 154 is slid into a corresponding slot 156 formed in the split ring locking mechanism 134. The corresponding slot 156 may have one or more undercut regions 158 with which side extensions 160 of key 154 are engaged as key 154 is moved into slot 156. The side extensions 160 allow the key to move back and forth in slot 156 but prevent the key 154 from falling out of slot 156 once the split ring locking mechanism 134 is engaged with adjacent components.

The key 154 retains adjacent components in a rotationally locked position by preventing rotation of split ring locking mechanism 134 in the same manner as pin 128 of the snap ring member 124 described above with reference to FIGS. 15 and 16. In operation, the split ring locking mechanism 134 is rotated until sufficiently tight and until the key 154 can be moved into an aligned castellation 138 of an adjacent component, as best illustrated in FIG. 22. The key 154 is then slid into the aligned castellation until it engages both the split ring locking mechanism 134 and the adjacent component. In this position, key 154 prevents relative rotation between the split ring locking mechanism and the adjacent component. The key 154 may be prevented from sliding back into slot 156 by an appropriate blocking member 162, such as a set screw positioned behind the key after the key is moved into its locking position. The set screw 162 prevents the key 154 from moving fully back into slot 156 until removal of the set screw. It should be noted that many of these retention mechanisms also can be used in combination. For example, interlocking castellations 130, 132 can be combined with belleville washers 150, keys 154, wedge ring portions 142, or other locking devices in these and other combinations.

Figure 23:
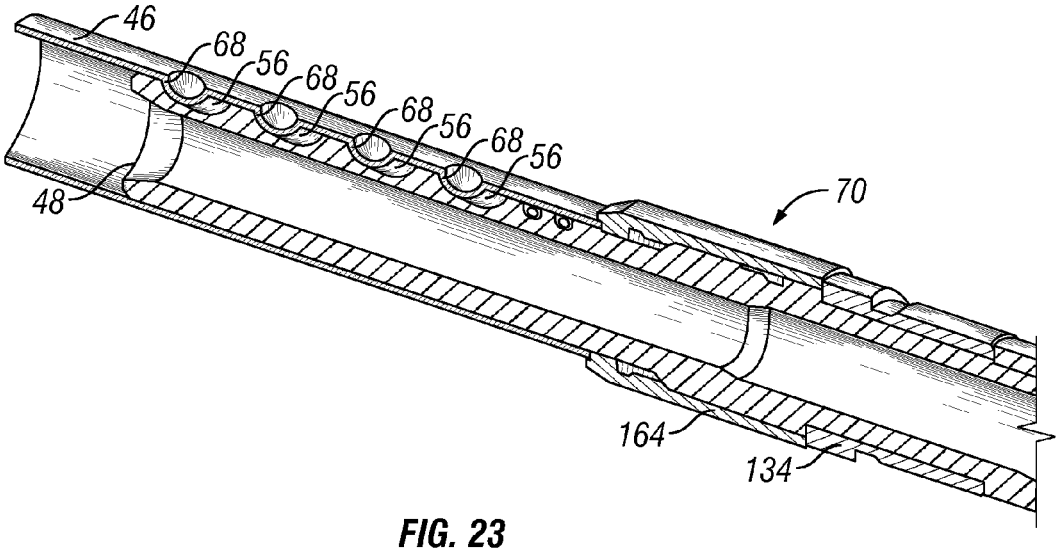
FIG. 23 illustrates another embodiment of a retention device, according to an embodiment of the present invention.

Another embodiment of retention mechanism 70 is illustrated in FIG. 23. In this embodiment, a jam nut 164 prevents inadvertent separation of adjacent components, such as separation of coiled tubing 46 from an adjacent component. The jam nut 164 can be used to force coiled tubing 46 and specifically protrusions 68 into more secure engagement with slots 56, e.g. against the wall surfaces forming slots 56. In one embodiment, jam nut 164 is used to securely move protrusions 68 into a J-slot portion of each slot 56. A split ring 134 may be used with the connector 48 to prevent loosening of jam nut 164, thereby ensuring a secure connection. It should be further noted that additional retention mechanisms can be used for other types of connections, such as threaded connections. For example, threaded connections can be secured with a thread locking compound, such as a Baker™-lock and Loctite™ thread locking compound.

Figure 24:
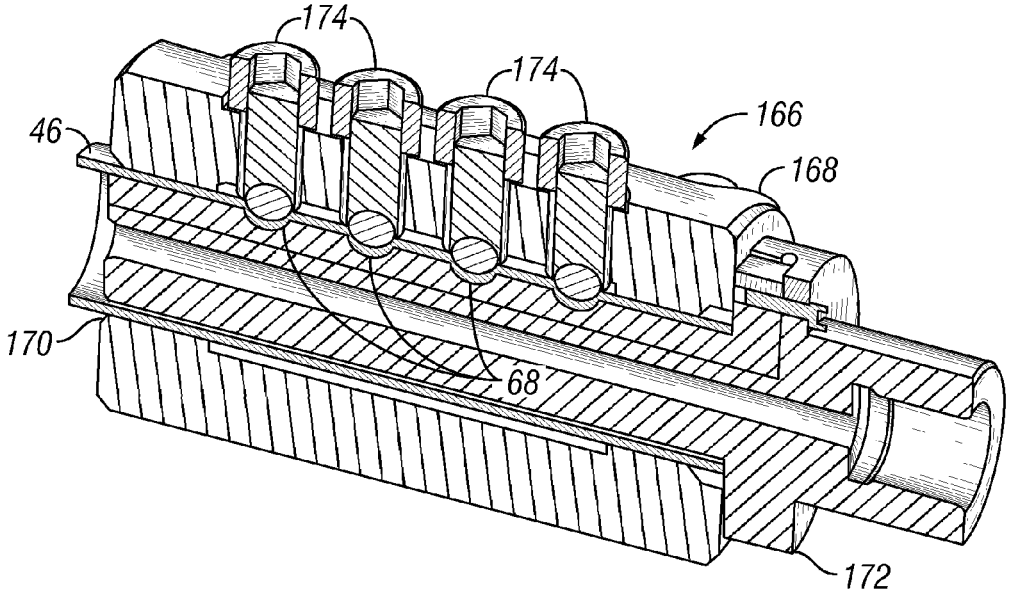
FIG. 24 illustrates a fixture used to form depressions in the coiled tubing for engagement with devices, such as those illustrated in FIGS. 2 and 5, according to an embodiment of the present invention.

As briefly referenced above, a forming tool 166 can be used to form depressions in the exterior of coiled tubing 46 that result in inwardly directed protrusions 68, as illustrated in FIG. 24. The forming tool 166 comprises a tool body 168 with an interior, longitudinal opening 170 sized to receive an end of the coiled tubing 46 therein. A mandrel 172 can be inserted into the interior of coiled tubing 46 to support the coiled tubing during formation of protrusions 68. Additionally, a plurality of tubing deformation members 174 are mounted radially through tool body 168. The tubing deformation members 174 are threadably engaged with tool body 168 such that rotation of the tubing deformation members drives them into the coiled tubing to form inwardly directed protrusions 68. Mandrel 172 can be designed with appropriate recesses to receive the newly formed protrusions 68, as illustrated.

The connectors described herein can be used to connect coiled tubing to a variety of components used in well applications. Additionally, the unique design of the connector enables maximization of flow area while maintaining the ability to pass the connector through a coiled tubing injector. The connector and the methodology of using the connector also enable preparation of coiled tubing connections while at a well site. Additionally, a variety of locking mechanisms can be combined with the connector, if necessary, to prevent inadvertent disconnection of the connector from an adjacent component. The techniques discussed above can be used for all tool joints in a downhole tool string.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of forming a flow-through connection with a coiled tubing, comprising:

swaging an end of the coiled tubing at a well site to form a round connection end;

providing a thread cutting tool to the well site;

cutting a thread pattern into the round connection end at the well site with the thread cutting tool; and threadably engaging a connector with the round connection end while at the well site, the connector having an engagement end comprising a corresponding thread pattern, the connector defining a hollow interior therein for conducting well fluids therethrough.

2. The method as recited in claim 1, wherein the cutting comprises cutting an interfering thread pattern into the coiled tubing and the round connection end; and further comprising continuing movement of the corresponding thread pattern into the interfering thread pattern until formation of an interfering threaded connection.

3. The method as recited in claim 1, wherein the swaging comprises swaging with an internal swage.

4. The method as recited in claim 1, wherein the swaging comprises swaging with an external swage.

5. The method as recited in claim 1, wherein the cutting comprises using a tap to cut an internal thread in an interior of the coiled tubing.

6. The method as recited in claim 2, wherein the continuing comprises creating sacrificial threads such that the connector cannot be released from the coiled tubing.

7. The method as recited in claim 5, wherein the cutting comprises using a second tap to finish an interfering thread pattern.

8. The method as recited in claim 1, further comprising deploying an elastomeric seal intermediate the engagement end of the connector and the coiled tubing, the seal comprising a seal to prevent fluid flow from an exterior of the coiled tubing to the interior of the connector or coiled tubing.

9. A system for forming a coiled tubing connection at the well site, comprising:

a coiled tubing having an end threaded with an interfering thread;

a connector having an engagement end with a corresponding interfering thread, wherein threadably engaging the corresponding interfering thread and the interfering thread creates a sacrificial threaded connection to prevent the connector from being released from the coiled tubing; and a wellbore device coupled to the coiled tubing by the connector, the connector further defining a hollow interior and wherein the wellbore device is operable to receive flow through the coiled tubing and the connector.

10. The system as recited in claim 9, further comprising a seal member deployed between the engagement end and the coiled tubing, the seal member comprising a seal to prevent fluid flow from an exterior of the coiled tubing to an interior of the connector or coiled tubing.

11. The system as recited in claim 9, wherein the end of the coiled tubing is internally threaded with the interfering thread.

* * * * *